US010919078B2

(12) United States Patent
Boselli et al.

(10) Patent No.: US 10,919,078 B2
(45) Date of Patent: Feb. 16, 2021

(54) LAMINATION CYLINDER

(71) Applicants: Giovanni Boselli, Milan (IT); Massimo Cavallari, Varese (IT); Paolo Gaboardi, Como (IT); Rick McWhirter, Wollongong (AU); Massimo Perassolo, Alessandria (IT); Claudio Trevisan, Varese (IT)

(72) Inventors: Giovanni Boselli, Milan (IT); Massimo Cavallari, Varese (IT); Paolo Gaboardi, Como (IT); Rick McWhirter, Wollongong (AU); Massimo Perassolo, Alessandria (IT); Claudio Trevisan, Varese (IT)

( * ) Notice: Subject to any disclaimer, the term of this patent is extended or adjusted under 35 U.S.C. 154(b) by 381 days.

(21) Appl. No.: 14/289,491

(22) Filed: May 28, 2014

(65) Prior Publication Data

US 2014/0352384 A1 Dec. 4, 2014

(30) Foreign Application Priority Data

May 30, 2013 (IT) ..... MI2013A0879

(51) Int. Cl.
*B21B 27/00* (2006.01)

(52) U.S. Cl.
CPC ..... *B21B 27/005* (2013.01); *B21B 2267/10* (2013.01)

(58) Field of Classification Search
CPC ..... B21B 27/005; B21B 2267/10
USPC ..... 72/252.5
See application file for complete search history.

(56) References Cited

U.S. PATENT DOCUMENTS 3,404,254 A * 10/1968 Jones ..... B23K 15/02 219/121.19
4,028,523 A * 6/1977 Anderl ..... B23K 15/00 219/121.2
4,329,562 A * 5/1982 Crahay ..... B21B 27/005 219/121.19
4,628,179 A * 12/1986 Crahay ..... B21B 27/005 219/121.68
4,758,705 A * 7/1988 Hertzel ..... B23K 26/0084 219/121.6
5,338,915 A * 8/1994 Hildebrand ..... B23K 26/0084 219/121.61
5,509,119 A * 4/1996 La Fetra ..... G06F 11/1064 714/52
5,789,066 A * 8/1998 De Mare ..... B21B 1/227 29/17.1

(Continued)

FOREIGN PATENT DOCUMENTS

CN 102699524 A * 10/2012
CN 103639592 A * 3/2014

(Continued)

OTHER PUBLICATIONS

Machine Translation of CN 102699524, Translated May 7, 2018, 5 pages.*

(Continued)

*Primary Examiner* — Gregory D Swiatocha
(74) *Attorney, Agent, or Firm* — Themis Law

(57) ABSTRACT

A lamination cylinder includes a surface structure, on which a plurality of craters is defined having a different geometry and a random distribution. Some of the craters are partially superimposed with respect to each other.

4 Claims, 4 Drawing Sheets

(56) References Cited

U.S. PATENT DOCUMENTS

| | | | | | |
|---|---|---|---|---|---|
| 5,807,444 | A * | 9/1998 | Paradis | B22D 11/0648 | 148/542 |
| 6,138,490 | A * | 10/2000 | Shannon | B21B 1/227 | 72/252.5 |
| 2004/0112104 | A1 * | 6/2004 | Scamans | B21B 1/227 | 72/187 |
| 2012/0225761 | A1 * | 9/2012 | Gaspard | C21D 1/10 | 492/3 |

FOREIGN PATENT DOCUMENTS

| | | | | | |
|---|---|---|---|---|---|
| DE | 4102984 | A1 * | 4/1992 | B21B 27/005 | |
| EP | 0472049 | | 2/1992 | | |
| SU | 1574299 | | 6/1990 | | |
| WO | 9205890 | | 4/1992 | | |
| WO | WO 199205890 | A1 * | 4/1992 | B21B 27/005 | |

OTHER PUBLICATIONS

Human Translation of DE 4102984, corresponding to WO 92/05890, Translated Nov. 2018, 28 Pages. (Year: 1992).*

Human Translation of CN 102699524, Translated May 2018, 28 Pages.(Year: 2012).*

Machine translation of CN103639592, 5 Pages. (Year: 2014).*

Dolves J, Electron Beam Texturing of Rolls, AISE Steel Technology, AISE, Pittsburgh, PA, vol. 68, No. 8, Aug. 1, 1991; pp. 33-38, p. 35, right-hand column; Fig. 8.

* cited by examiner

Fig. 1
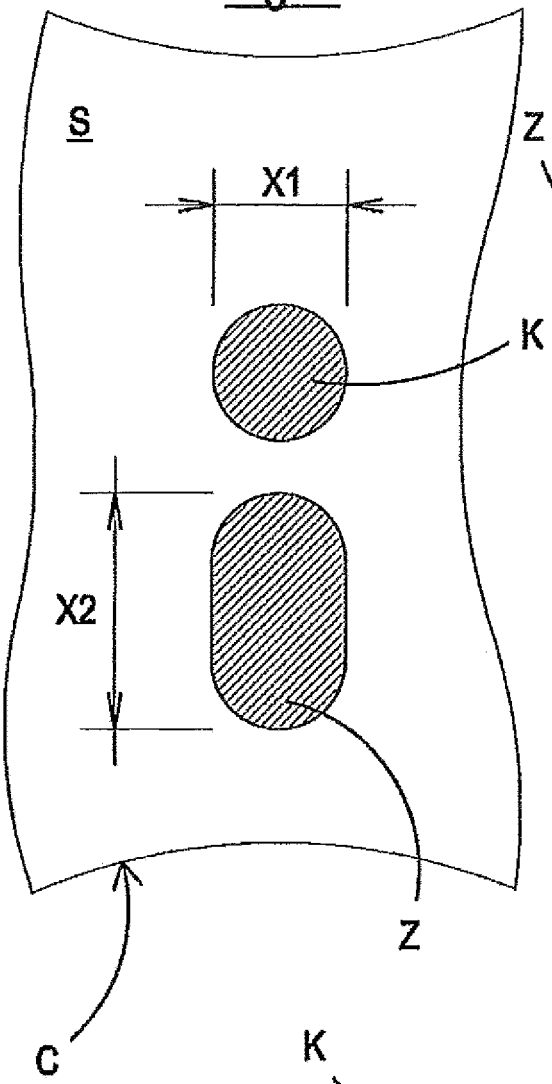
Fig. 2
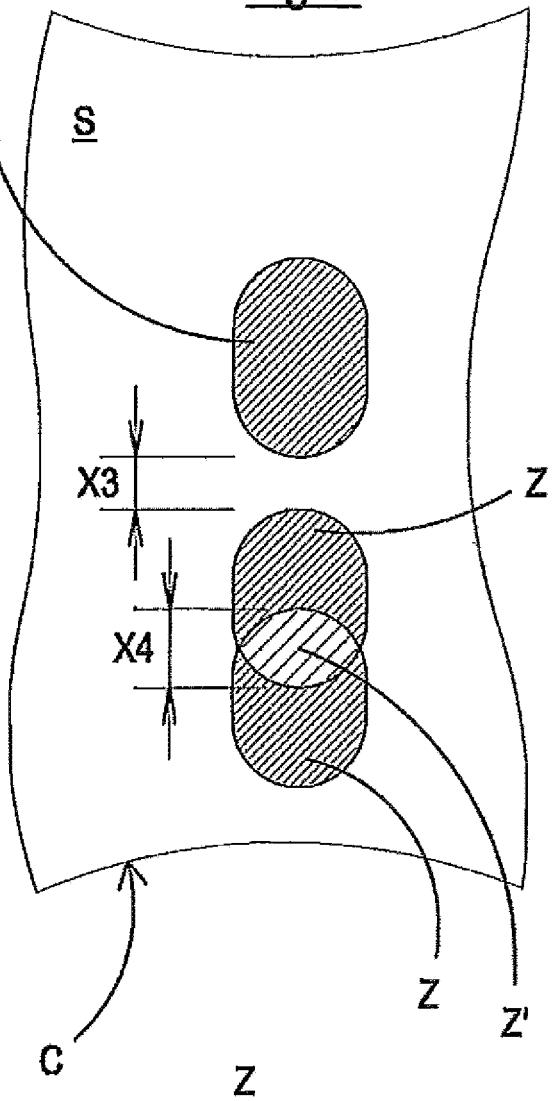
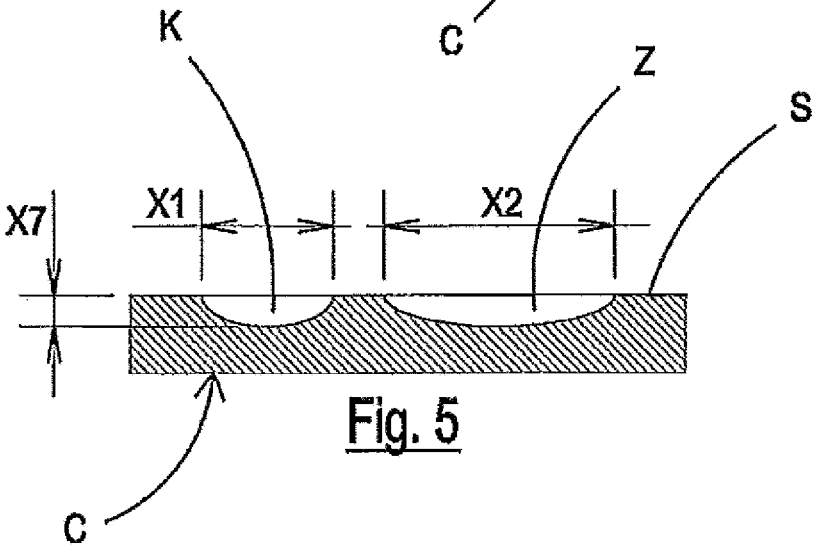
Fig. 5

Fig. 3
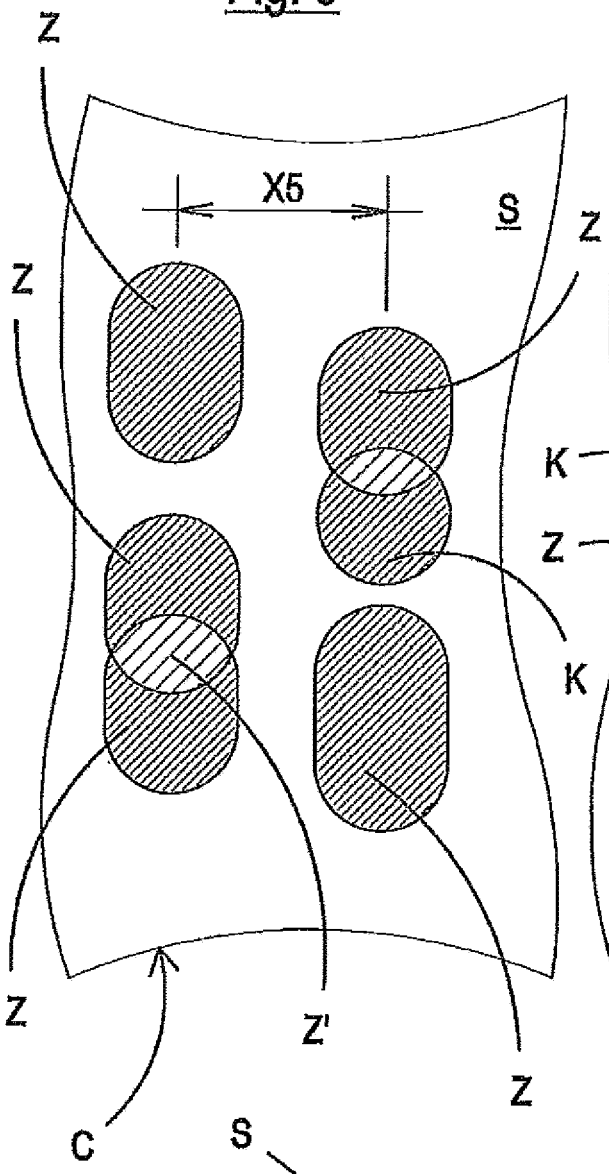
Fig. 4
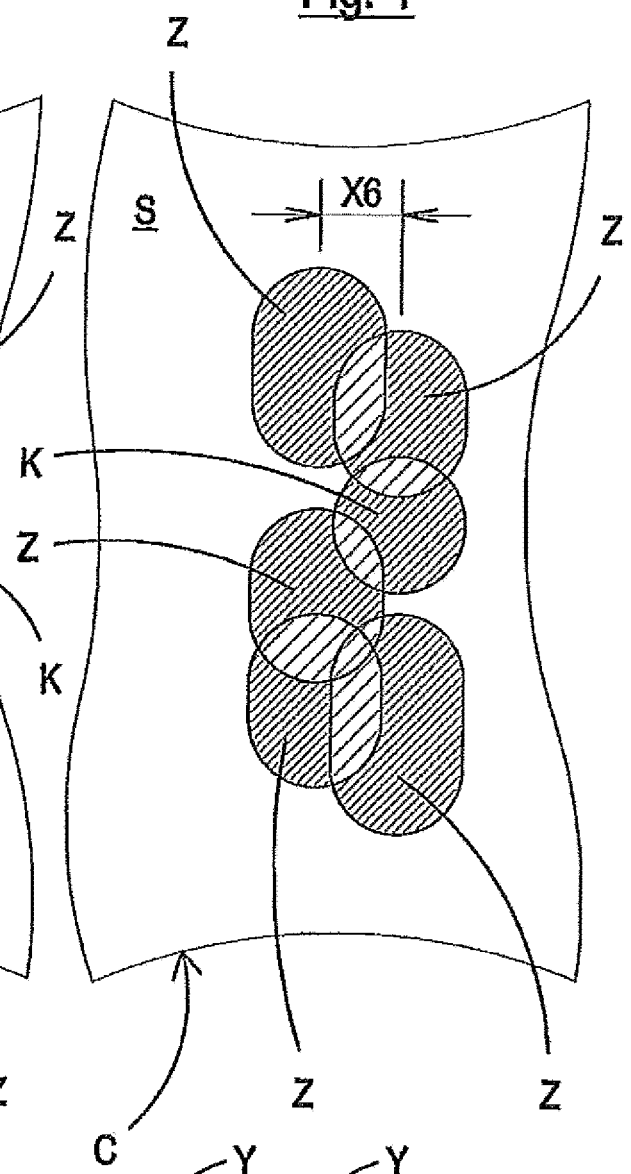
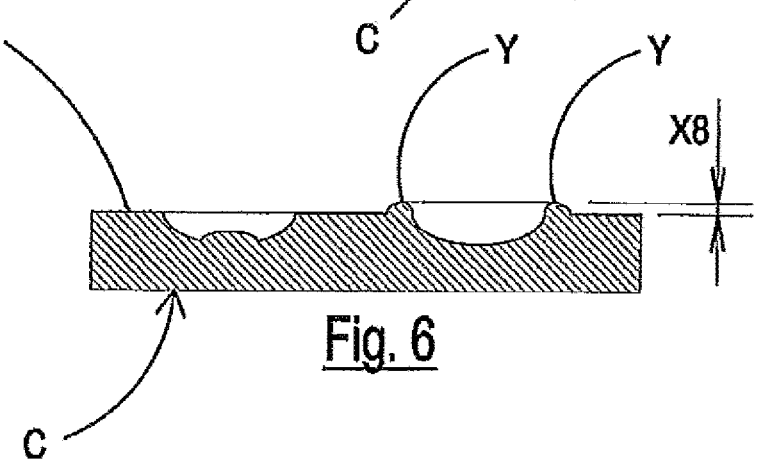
Fig. 6

$$\begin{cases} K1 = \text{constant part} \\ Rnd1 = \text{random part} \\ K2 = \text{constant part} \\ Rnd2 = \text{random part} \\ Toff2 = K1 + Rnd1 \\ Ton2 = K2 + Rnd2 \end{cases} \quad \begin{cases} D1 < D2 \\ D2 < D3 \\ D3 > D4 \\ D4 > D5 \\ Z1 < Z2 \\ Z5 < Z3 \end{cases} \quad \begin{cases} Ton1 < Ton2 \\ Ton2 < Ton3 \\ Ton3 > Ton4 \\ Ton4 > Ton5 \end{cases}$$

$$\left\{\begin{array}{l} PK1 = \text{constant part} \\ PRnd1 = \text{random part} \\ \\ P1 = PK1 + PRnd1 \end{array}\right. \quad \left\{\begin{array}{l} Z2 > Z4 \\ D2 > D4 \\ \\ D1 < D2 \\ D2 < D3 \\ D3 > D4 \end{array}\right. \quad \left\{\begin{array}{l} P2 > P4 \\ Ton2 = Ton4 \\ \\ Ton1 < Ton2 \\ Ton2 < Ton3 \\ Ton3 > Ton4 \end{array}\right.$$

LAMINATION CYLINDER

FIELD OF THE INVENTION

The present invention relates to a lamination cylinder.

In particular, the present invention relates to a lamination cylinder having certain surface characteristics suitable for allowing the same cylinder to be advantageously used in rolling mills, to which the following description refers specifically, at the same time maintaining its generic nature, for producing sheets, in particular metal sheets and similar products, with surface characteristics, including roughness, which are such as to make them suitable for use in applications such as molding, coating and varnishing.

BACKGROUND OF THE INVENTION

A process for the lamination of metals, generally includes passing a metallic sheet through a pair of rotating cylinders, the torque of which provides the sheet with a certain thickness and hardness and, in some cases, for example in the cold lamination of flat products for the construction of automobiles and household appliances, with a specific surface roughness, as the geometric surface characteristics are reproduced, in negative, on the treated sheet.

The above roughness parameter, and consequently the geometric surface characteristics of the lamination cylinders, is predetermined in relation to the final use of the sheet obtained by passage through the above-mentioned pair of cylinders, and is also defined as a random distribution of ridges and craters with internal dimensions within a certain range of values.

The above-mentioned cylinders used for lamination must generally be periodically rectified due to the deterioration to which they are subject during the production process and not always this rectification process is sufficient for providing the surface of the cylinder with all the necessary characteristics, at times requiring, for example in the above applications, an additional surface treatment which allows a certain roughness degree to be obtained and controlled.

The surface treatment of a lamination cylinder for obtaining the desired roughness is currently performed using various technologies, of which the most widely-used are blasting and electro-erosion, also known to experts in the field as EDT (Electro Discharge Texturing).

These treatment technologies provide for a good regulation of the average roughness, but are characterized by a dangerous process and a high environmental impact and consequently with considerable complexity in the management and disposal of the residues, in addition to the operating costs.

Blasting, for example, requires considerably sized plants which, for their functioning, use large turbines which are noisy and dangerous. This process, moreover, generates dust emitted from the abrasive sand of significant toxicity, which must be purified and filtered by a specific system. Finally, the nature of the blasting process requires considerable maintenance due to the abrasive that is used, which damages numerous components which cannot be adequately protected. In addition to the above, blasting does not provide for a good control of the roughness and consequently the cylinders treated with this process produce a laminated product which, with respect to roughness, has poor homogeneity.

The above-mentioned electro-erosion or EDT is a technology, which currently offers the best results from a qualitative point of view, due to the homogeneity of the roughness that is obtained and the total absence of traces from the processing.

This technology, however, is potentially dangerous due to the wide use of flammable products, such as a dielectric liquid, which requires the installation of a sophisticated irrigation system in order to reduce the consequence of fire. EDT also has an extremely significant environmental impact, as dielectric fluid is highly toxic and must be frequently disposed of using special procedures.

Another known technology, although rarely used, adopts a process called EBT (Electron Beam Texturing), in which the material is melted locally by a beam of electrons, forming a micro-crater and a ridge of molten material deposited on the walls of the crater.

A considerable drawback of this technology is the processing of the cylinder, which must be performed inside a vacuum chamber. This makes this technology extremely costly and not particularly suitable for metallic lamination processes.

There are analogous drawbacks with the ECD (Electrolytic Chrome Deposition) process, which uses a pulsed current for creating a rough surface, which, moreover, creates considerable problems from the standpoint of disposal.

Finally, another currently available method employs a laser beam suitable for defining a certain surface roughness of the lamination cylinder.

The use of a laser beam is overcomes the problems of the above described methods and has various advantages, in particular the optimum creation of craters on the surface of the lamination cylinder. Furthermore it has no drawbacks from the environmental standpoint.

SUMMARY OF THE INVENTION

The object of the present invention is, therefore, to provide a lamination cylinder having a particular distribution of craters with a roughness defined and formed on the surface, preferably with the use of pulsed laser beams.

BRIEF DESCRIPTION OF THE DRAWINGS

The structural and functional characteristics of the present invention and its advantages over the known art will appear even more evident from the following description, with reference to the enclosed drawings, which show schematizations of some preferred but non-limiting embodiments of the surface of a lamination cylinder, in which:

FIG. 1 illustrates the main single forms of reproducible craters on the surface of a lamination cylinder according to the invention;

FIG. 2 represents, in a plan view, a first preferred configuration of craters created on the surface of a lamination cylinder;

FIG. 3 represents, in a plan view, a second preferred configuration of craters created on the surface of a lamination cylinder according to the invention;

FIG. 4 represents, in a plan view, a third preferred configuration of craters created on the surface of a lamination cylinder according to the invention;

FIG. 5 illustrates, in a side sectional view, a portion of a lamination cylinder according to the invention, having the two forms of craters of FIG. 1;

FIG. 6 illustrates, in a side sectional view, a further portion of a lamination cylinder according to the invention;

DETAILED DESCRIPTION OF EMBODIMENTS OF THE INVENTION

With reference to the enclosed figures, S indicates as a whole the peripheral surface of a lamination cylinder C on which circular craters K and oval craters Z are produced according to particular arrangements, also superimposed with respect to each other, as specified hereunder, thus reproducing a random distribution with no apparent patterns, but with a good consistency and with a wide range of roughness parameters.

Said craters K and Z are advantageously formed on the surface S preferably by means of pulsed laser-ray beams, varying the power and duration of the laser beam, in addition to the activation frequency.

The circular craters K have a diameter X1, whereas the oval craters Z have a diameter X1 and a length X2.

According to the first preferred but non-limiting configuration illustrated in FIG. 2, oval craters Z are created on the surface S of the cylinder in sequence according to a helical path. The arrangement is such that each oval crater Z is formed along the helix at a distance X3 from an ovaloid and elongated crater Z' defined by the partial superimposition of two oval craters Z positioned at a distance X4 from each other along the helix.

According to the second preferred but non-limiting configuration illustrated in FIG. 3, a crater KZ defined by a circular crater K partially superimposed with respect to an oval crater Z and a further oval crater Z, are added to the arrangement of craters Z, Z' represented in FIG. 2. The distance between the two arrangements is equal to a value X5, equal to the distance between two consecutive helixes.

According to the third preferred but non-limiting configuration illustrated in FIG. 4, the circular craters K and oval craters Z are created on the surface S variably superimposed with respect to each other according to variable and random sequences, and with distances X6 which are also variable and random determined by the distance of two consecutive helixes.

The depths X7 of the craters and the thicknesses X8 of the ridges Y thus formed (FIGS. 5 and 6) can also be varied as desired, thus obtaining a desired roughness degree.

Figures 7, 8, 9:
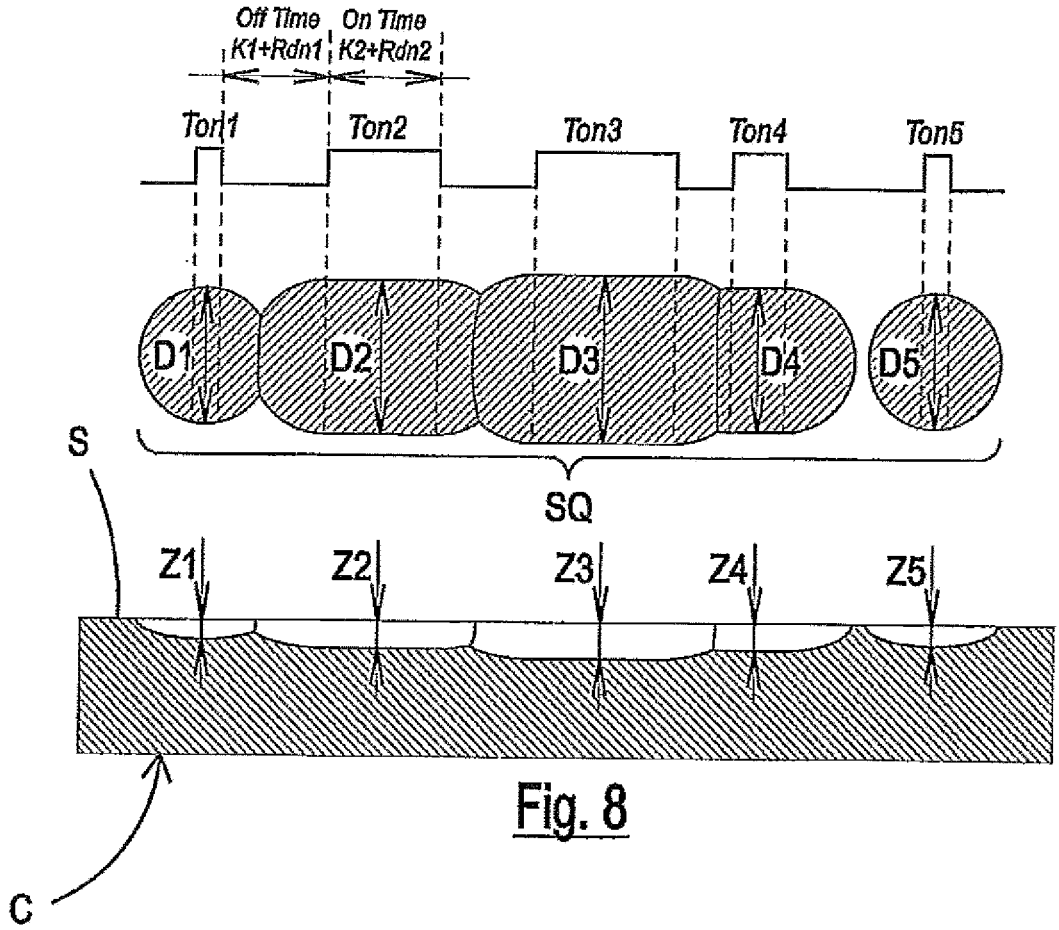
FIG. 7 represents, in a plan view, a fourth preferred configuration of craters created on the surface of a lamination cylinder according to the invention.
FIG. 8 illustrates, in a side sectional view, a portion of the surface of a lamination cylinder according to the invention, having the forms of craters of FIG. 7.
FIG. 9 is a table of the values of some variables for obtaining the craters illustrated in FIGS. 7 and 8.

According to the fourth preferred but non-limiting configuration illustrated in FIGS. 7 and 8, the circular craters K and the oval craters Z are substantially aligned along the helix, have transversal dimensions/diameters Di with a varied and random trend, for example increasing-decreasing-increasing as can be seen in FIG. 7, and are created on the surface S variably superimposed with respect to each other according to a predefined sequence SQ, and with a depth having a varied and random trend, as can be seen in FIG. 8.

In order to obtain the arrangement of craters of the fourth configuration of FIGS. 7 and 8, the switching-on and switching-off time of the laser source is suitably modulated, generating a pulsed laser beam according to what is specifically indicated in the values of the table of FIG. 9. This way, a first crater of the sequence SQ can and is obtained, for example, with a diameter D1 obtained by a laser pulse having a shorter duration Ton1 with respect to the laser pulse having the duration Ton2, which generates a second crater with a diameter D2, and this implies that the two subsequent craters have different depths Z1<Z2 and different diameters D1<D2.

Figures 10, 11, 12:
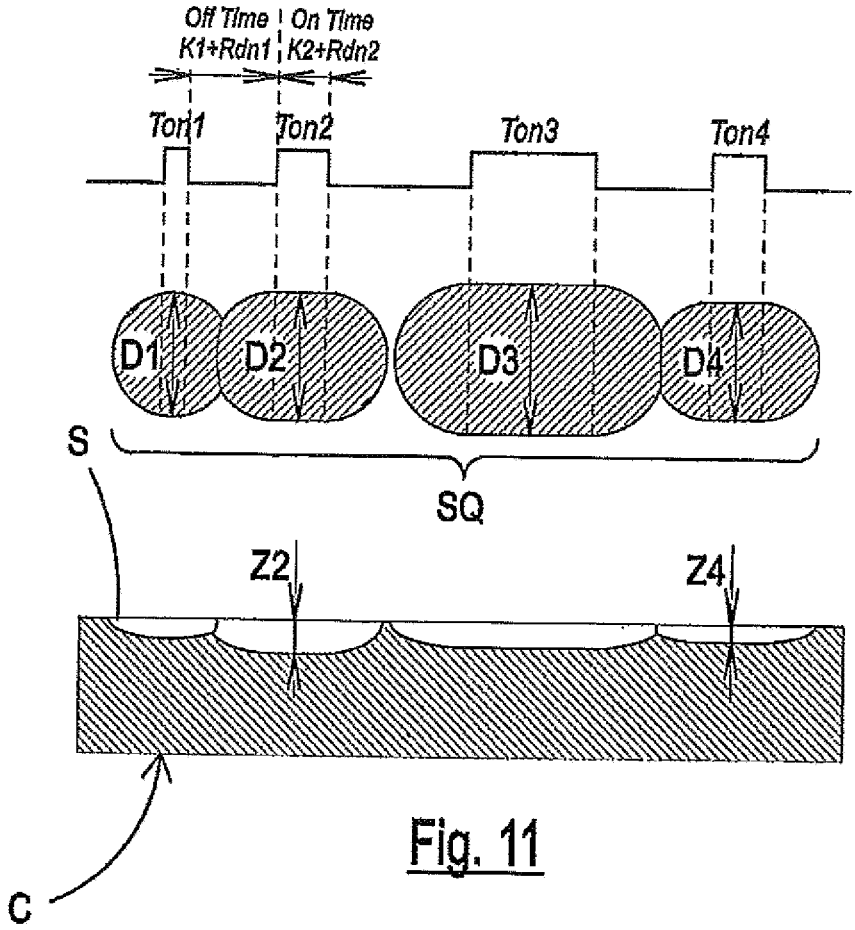
FIG. 10 represents, in a plan view, a fifth preferred configuration of craters created on the surface of a lamination cylinder according to the invention.
FIG. 11 illustrates, in a side sectional view, a portion of the surface of a lamination cylinder according to the invention, having the forms of craters of FIG. 10.
FIG. 12 is a table of the values of some variables for obtaining the craters illustrated in FIGS. 10 and 11.

According to the fifth preferred but non-limiting configuration illustrated in FIGS. 10 and 11, with the values of the table of FIG. 12, the sequence SQ of craters is obtained by suitably modulating the emission power P of the pulsed laser according to a constant signal, to which a random signal is added. This provides for the formation of craters having different dimensions and depths.

In addition to what is described above, the present invention offers the advantage of managing the ratio between the surface, on which the craters described above are created, and the non-treated surface, as desired. This characteristic offers a further parameter available to the surface treatment process of the cylinder for improving the characteristics of the laminated product.

Finally, it should be pointed out that, as the sequence of craters on the surface of the cylinder is generated by means of a melting process in a controlled atmosphere, the hardness characteristics of the surface of the cylinder are generally improved with respect to the above described traditional processes, as the cooling of the material takes place in an atmosphere of a suitable gas at a controlled temperature. This enables the cylinder to tolerate longer lamination processes without consequences, without deteriorating the quality of the laminated product.

The protection scope of the invention is defined by the following claims.

The invention claimed is:

1. A method of etching a lamination cylinder comprising:

providing the lamination cylinder; and defining a plurality of craters on the lamination cylinder, the craters having different geometries and a random distribution and being partially superimposed with respect to each other, wherein the step of defining the plurality of craters comprises:

rotating the lamination cylinder around a longitudinal axis; and etching the lamination cylinder with a laser beam along one or more helical patterns, wherein the laser beam is pulsed at varying intervals of time and for varying durations, thereby causing the craters to achieve the random distribution and further causing some of the craters to be partially superimposed with respect to each other, wherein use of the laser beam causes an increased hardness of a surface of the lamination cylinder, thereby causing the lamination cylinder to tolerate longer lamination processes without loss of quality of a laminated product, and wherein the one or more helical patterns have varying distances therebetween.

2. The method according to claim 1, wherein the laser beam is pulsed to cause some of the craters to have a circular perimeter and some of the craters to have an elongated perimeter.

3. The method according to claim 1, wherein the laser beam is pulsed to cause the craters to have varying depths.

4. The method according to claim 1, wherein there is a plurality of helical patterns.

* * * * *